US005676490A

United States Patent [19]

Nelson

[11] Patent Number: 5,676,490

[45] Date of Patent: Oct. 14, 1997

[54] MACHINE FOR CUTTING HIGHWAY RUMBLE STRIPS

[76] Inventor: Dale J. Nelson, 46125 266th St., Hartford, S. Dak. 57033

[21] Appl. No.: 629,019

[22] Filed: Apr. 8, 1996

[51] Int. Cl.[6] ..... E01C 23/09

[52] U.S. Cl. ..... 404/94; 299/39.4

[58] Field of Search ..... 404/12, 72, 90, 404/93, 94, 118; 299/39.4, 39.5

[56] References Cited

U.S. PATENT DOCUMENTS

| | | | |
|---|---|---|---|
| 5,078,540 | 1/1992 | Jakob et al. | 404/90 |
| 5,092,658 | 3/1992 | Smith | 299/39 |
| 5,114,269 | 5/1992 | Shepherd | 404/122 |
| 5,297,894 | 3/1994 | Yenick | 404/90 |
| 5,391,017 | 2/1995 | Thomas et al. | 404/90 |
| 5,607,255 | 3/1997 | Thomas et al. | 404/90 |

OTHER PUBLICATIONS

Pamphlet by Wirtgen America from *Wirtgen Connection* pp. 14–18 1995.

*Primary Examiner*—James Lisehora
*Attorney, Agent, or Firm*—James V. Harmon

[57] ABSTRACT

An apparatus for cutting highway rumble strips comprises a vehicle that includes a supporting framework, e.g., a framework formed from steel channels welded together and having four ground-engaging wheels, one mounted at each corner of the framework for supporting the vehicle and allowing it to move freely under its own power or to be towed down the highway. A cutter, e.g., a cutting head or cutting wheel with carbide steel cutting teeth, is supported on the framework for producing a series of spaced apart transverse cuts in the pavement as the vehicle travels, usually at a uniform speed along the shoulder of the highway. The cutter can be a toothed wheel that is rotated on an axis at its center by a drive motor, engine, or other prime mover. Connected to the cutter is a mechanism for periodically imparting retrograde motion to the cutter relative to the framework to enable the cutter to temporarily discontinue its forward movement relative to the highway as each cut is made such that the cutter moves bodily relative to the vehicle at substantially the same speed that the vehicle moves on the highway but in the opposite direction. This enables the vehicle as a whole to move much more rapidly down the road without jeopardizing the quality of the cuts being produced. In addition, it enables a cutting wheel of a given size to produce a smaller, more effective and more well defined cut in the pavement than would be produced by an ordinary rumble strip cutter provided with a similar cutting wheel.

17 Claims, 12 Drawing Sheets

MACHINE FOR CUTTING HIGHWAY RUMBLE STRIPS

FIELD OF THE INVENTION

This invention relates to highway surfacing machines and more particularly to a machine for forming a rumble strip along the edge of a highway.

BACKGROUND OF THE INVENTION

A rumble strip consists of a series of parallel transversely extending grooves cut or otherwise formed, e.g., by molding, on the edge of a highway to warn a person whose car wanders onto the shoulder of the road. Several devices have been previously produced for cutting rumble strips, but they have been cumbersome and relatively slow in operation. For example, rumble strip cutters that are known to the applicant are capable of achieving speeds of only about fifty or sixty feet per minute, which makes the rumble strips relatively expensive to produce.

The primary object of the present invention is to provide an improved highway surfacing machine for efficiently producing rumble strips at a greater speed than that of current equipment.

A further object is to provide an improved highway rumble strip cutter which is rugged in construction, reliable in operation, and will efficiently operate at a speed of about one hundred feet per minute or more and produce at least 100 cuts per minute in an asphalt road surface.

A further, more specific object is to provide an improved highway rumble strip cutter with a provision in one form of the invention for reducing vibration during the cutting operation and for producing cuts with multiple cutting heads.

These and other more detailed and specific objects of the present invention will be better understood by reference to the following figures and detailed description which illustrate by way of example but a few of the various forms of the invention within the scope of the appended claims.

SUMMARY OF THE INVENTION

The invention provides a machine for cutting highway rumble strips comprising a vehicle that includes a supporting framework e.g., a framework formed from steel channels welded together and supported on four wheels, one mounted at each corner of the framework for allowing the vehicle to move freely under its own power or to be towed at the edge of the highway. A cutter, i.e., a cutting head, is supported on the framework for producing a series of spaced apart cuts in the pavement as the vehicle travels, usually at a uniform speed, along the shoulder of the highway. In one preferred form of the invention, the cutter is a toothed cutting wheel that is rotated on an axis at its center by a drive motor, engine, or other prime mover. Connected to the cutter is a means for periodically imparting retrograde motion to the cutter relative to the framework to cause the cutter to temporarily discontinue its forward movement relative to the highway as each cut is made such that the cutter moves relative to the vehicle at the same speed as the vehicle moves on the highway but in the opposite direction as each cut is produced to thereby cancel the forward motion of the vehicle. In this way, the cutter does not advance along the path that is being taken by the vehicle on the road but, instead, is stationary relative to the path of the vehicle as each cut is produced. This enables the vehicle as a whole to move more rapidly down the road without jeopardizing the quality of the cuts being produced. Each cut can be substantially the same size as one produced when the vehicle is stationary. In addition, it enables a cutting wheel of a given size to produce a smaller, more effective and more well defined cut in the pavement than would be produced by an ordinary rumble strip cutter provided with a similar cutting wheel.

During retrograde movement, the cutting wheel is preferably moved rearwardly at the same speed (while at its lowermost point of travel) that the vehicle moves on the highway. This motion is coordinated with simultaneous periodic vertical cycling so that the cutter is lowered into and raised out of each cut while the forward motion of the vehicle is nullified, enabling the cutter to move into and out of the cut along a generally vertical path relative to a point on the highway surface.

In one form, retrograde movement of the cutter is accomplished by revolving the cutter bodily so as to impart epicyclic motion to the cutter relative to the rectilinear path of motion of the vehicle as a whole along the highway. In another form of the invention, the retrograde motion is imparted to the cutter by supporting the cutter on a framework, shifting the framework rearwardly with a first actuator means, e.g., a reciprocating actuator such as a ball reverser to move it at the same speed that the vehicle moves in the opposite direction while lowering it, e.g., with a cam, then at the end of each cut elevating the cutter by means of a second actuator, e.g., a hydraulic cylinder actuator. Other forms are also described.

THE FIGURES

DETAILED DESCRIPTION OF THE INVENTION

Figure 1:
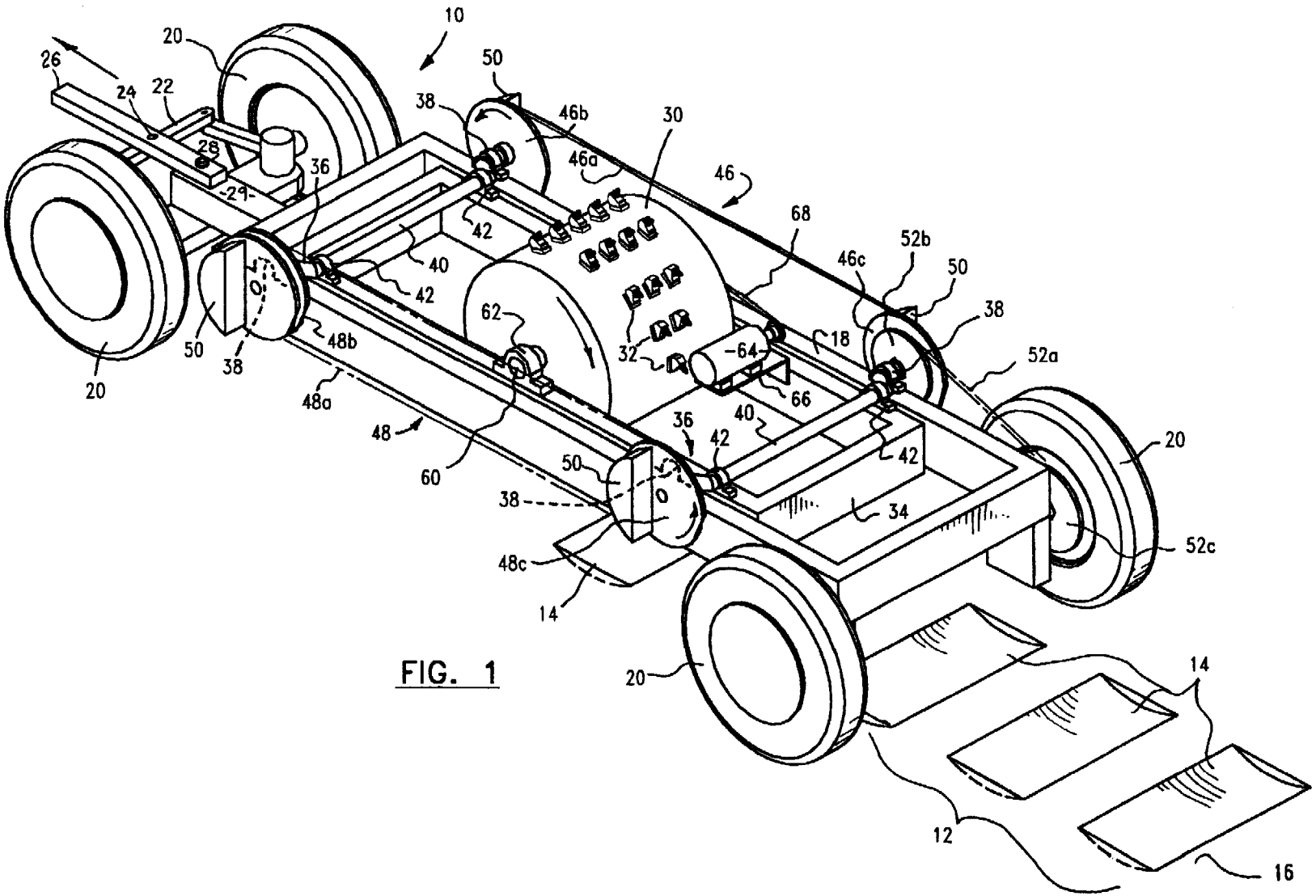
FIG. 1 is a diagrammatic perspective view of one form of the present invention.

Refer first to FIGS. 1–5 which illustrate a rumble strip cutting machine 10 in the form of a vehicle for cutting a rumble strip 12 consisting of a series of transversely extending parallel grooves 14 in the highway surface 16. The cutting machine or vehicle 10 includes a rectangular framework 18 formed from steel, e.g., four steel channel members welded at each corner of the framework 18 to provide a solid rectangular framework to which is connected four supporting wheels 20 that are mounted for rotation near the comers of the framework 18 and resting on the highway to enable the vehicle 10 to travel toward the left as seen in FIG. 1. The wheels 20 can be provided with rubber tires as shown and are mounted for rotation on axles with bearings of any suitable known construction, the two wheels at the left in the figure being supported for steering movement by means of a steering linkage 22 of conventional known construction and connected by a pivot 24 to a tow bar 26 which is itself pivotally connected at 28 to an extension 29 at the front of the framework 18. The vehicle 10 can be towed by means of a tractor or other vehicle (not shown) connected to the forward end of the tow bar 26. Alternatively, the vehicle 10 can be self-powered if desired and provided with any suitable steering mechanism and drive motor, e.g., a diesel engine, connected by means of a drive shaft (not shown) to the rear wheels at the right in FIG. 1.

Figure 3:
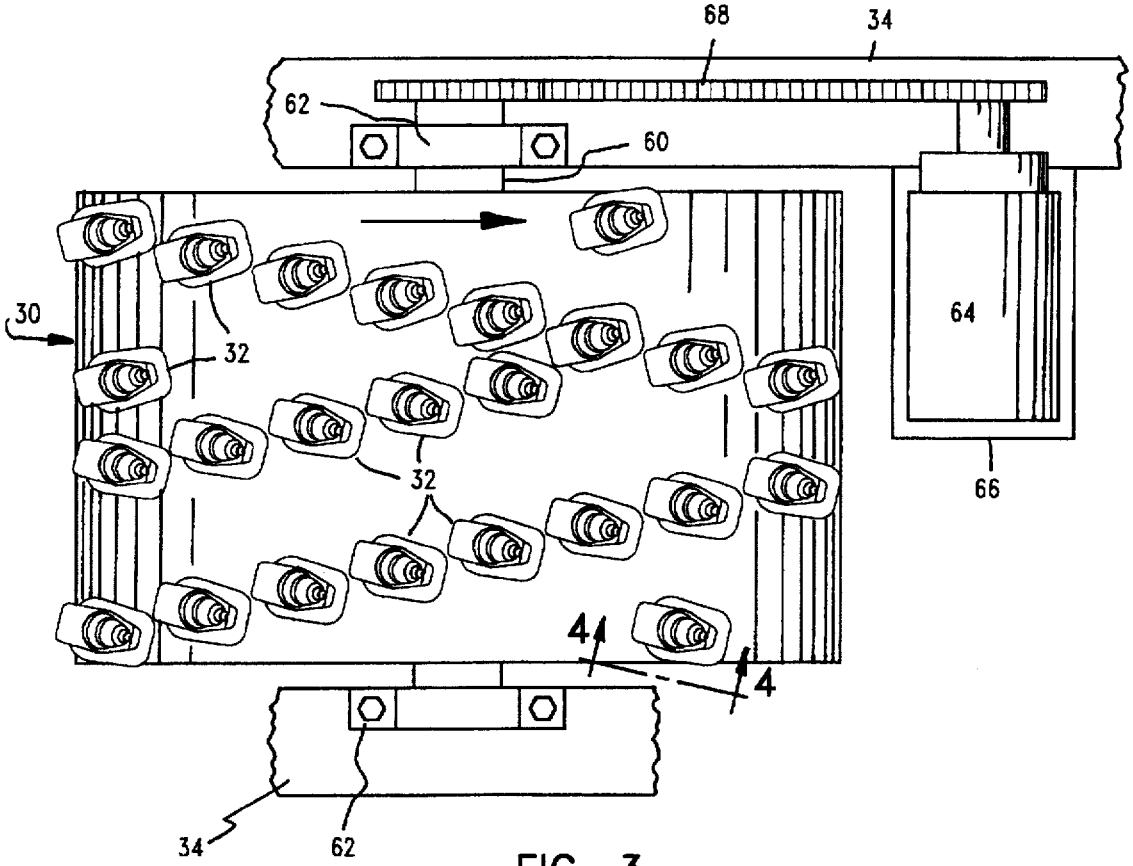
FIG. 3 is a plan view of the cutting wheel and associated structure of FIG. 1 on a larger scale.
Figure 4:
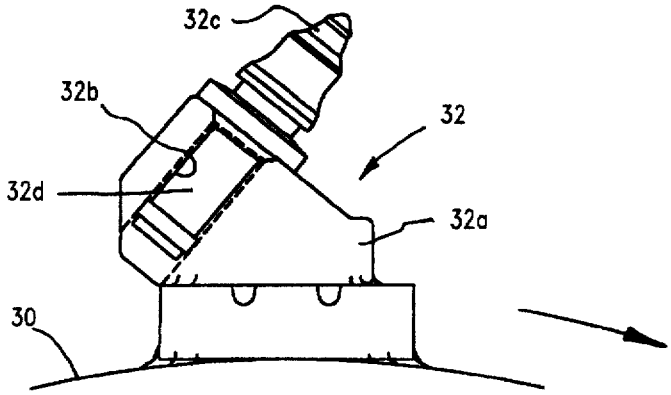
FIG. 4 is a side elevational view of one of the cutting teeth taken on line 4—4 of FIG. 3 on an enlarged scale.

At the center of the vehicle 10 is a cutting implement or wheel 30 supported on a shaft 60 and having a plurality of cutting teeth 32 which engage the surface of the road 16 to produce the cuts 14. A typical cutter wheel 30 has a diameter of about 26 inches and 46 cutting teeth. Each cutting tooth 32 can comprise a base **32*a* affixed, e.g., by welding, to the cutting wheel 30 and including an inclined bore 32*b* (FIG. 4). Each of the cutting teeth 32 has a conical point 32*c* with an integral cylindrical support shaft 32*d* which is journaled for rotation in bore 32*b* of the base 32*a* (FIG. 4). It will be seen that the cutting teeth 32 are inclined at an axis of about 45 degrees relative to the surface of the cutting wheel 30 and are also cocked at an angle relative to the shaft 60 (FIG. 3). The cutting teeth 32 are arranged in a suitable pattern, e.g., a V-shaped pattern as shown, to cut away all of the pavement between the side edges of each cut 14. The teeth 32** can be hardened carbide steel.

The mounting of the cutting head, i.e., cutting wheel 30 will now be described. The vehicle 10 is provided with an inner framework 34. The framework 34 can be a solid rectangular framework formed by welding four steel channels together to provide a rigid structure. The framework 34 is coupled to the main framework 18 by means of two similar crankshafts 36, each mounted for rotation on laterally spaced apart bearings 38 and each having a central crank throw 40 which is connected by laterally spaced apart bearings 42 to the inner framework 34. The crankshafts 36 are connected together at all times by means of a pair of chain-and-sprocket assemblies 46, 48 which include chain **46*a* and sprockets 46*b*, 46*c* on the right and chain 48*a* entrained over sprockets 48*b* and 48*c* on the left. It will be seen that the throw 40 of each crankshaft 36 is aligned with the other so that, as shown in the FIG. 1, each extends rearwardly. Likewise, throughout operation each of the crank throws 40 is made to extend in the same direction and at the same angle to the horizontal as the other crank throw 40. The crankshafts 36 are driven simultaneously during operation in the same direction by one of the wheels 20 as will be described below. Vibration is reduced by means of counterweights 50 connected to the sprockets 46*b*, 46*c*, 48*b* and 48*c* in a position to compensate for the motion of the oscillating framework 34**.

Rotational movement is imparted to the chain-and-sprocket assemblies 46, 48 by means of a chain drive assembly **52*a* comprising a chain entrained between sprockets 52*b* and 52*c*, the former being connected to the rear crankshaft 36 and the latter being connected to one or both of the rear drive wheels 20 to coordinate the epicyclic oscillation of the cutting wheel 30** with the speed of the vehicle.

In a typical example of the invention, each cut 14 is about six inches long from the front edge to the back edge, about five-eighths of an inch deep and about sixteen inches wide from one side edge to the other. In a typical application, the circumference of the crankshaft 36 is one foot which can provide a one-foot spacing between the centers of the cuts 14 so that both crankshafts 36, together with the oscillating framework 34 and the cutter 30, make one revolution for every foot of travel in a forward direction.

The cutter 30 in this case is a steel cylinder about two feet in diameter with its center shaft 60 mounted for rotation upon the oscillating framework 34 within laterally spaced apart bearings 62 (only one of which is shown in FIG. 1) that are connected rigidly to the framework 34 by being bolted to its top surface. The cutter 30 is also rotated on its own center by a suitable drive motor 64, e.g., an electric motor, internal combustion engine or rotary hydraulic motor, supported upon a motor mount 66 connected to the framework 34 and having a drive assembly, e.g., a chain-and-sprocket assembly 68 which turns the shaft 60 of the cutting wheel 30, typically at a speed of about 400 rpm.

During operation the rotation of the cutting wheel 30 removes portions of the surface of the road 16 as the teeth 32 strike the pavement. The oscillation of the framework 34 periodically imparts retrograde motion to the cutting wheel 30 relative to the framework 18, causing the cutting wheel 30 to temporarily discontinue its forward movement relative to the highway 16 as each cut 14 is made. The cutting wheel 30 moves relative to the vehicle 10 at the same speed as the vehicle 10 moves on the highway 16 but in the opposite direction as each cut is made to thereby cancel out the forward motion of the vehicle 10. Consequently, the cutting wheel 30 is stationary relative to the vehicle path 21 as each cut is produced. This enables the vehicle 10 as a whole to move much more rapidly down the road 16 without jeopardizing the quality of the cuts 14. In addition, it enables a cutting wheel 30 of a given size to produce a smaller, more effective and more well defined cut in the pavement than would be produced by an ordinary rumble strip cutter provided with a similar cutting wheel.

Figure 2:
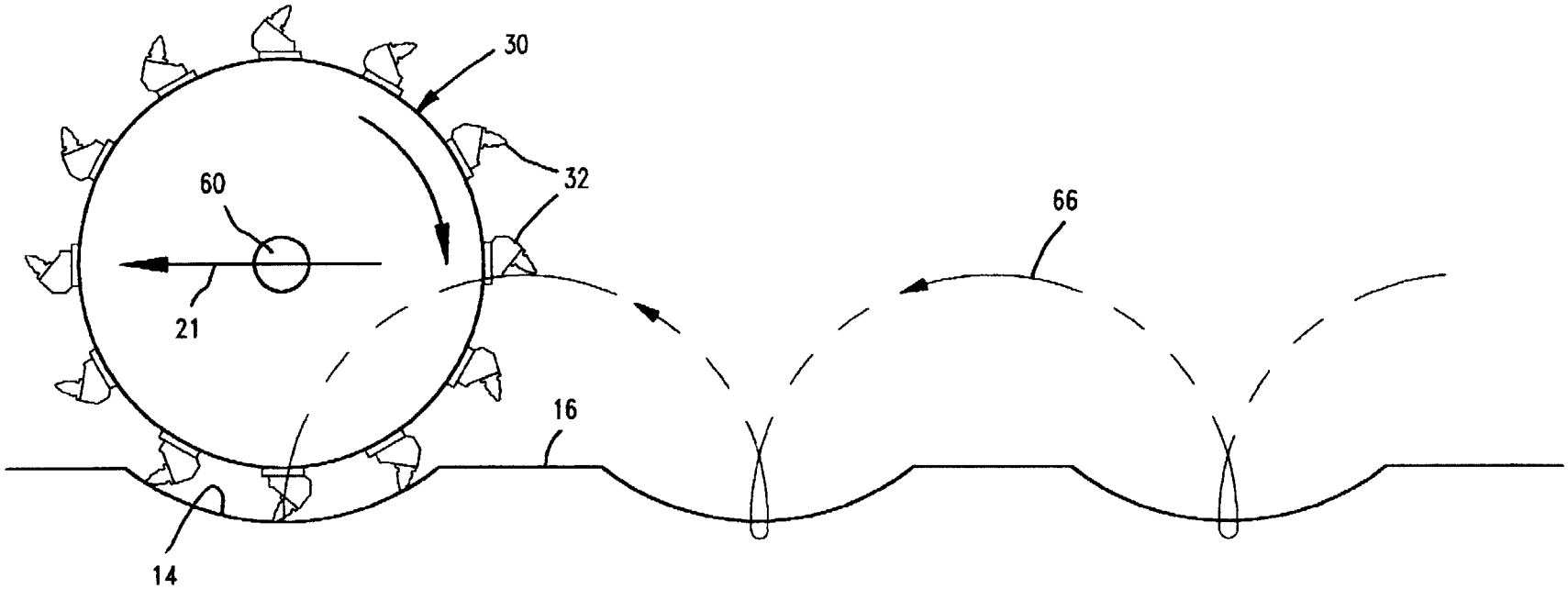
FIG. 2 is a diagram showing the cutting wheel in operation and the path taken by a point at the edge of the cutting wheel as the wheel moves from one cut to the next.

As shown in FIG. 2, the lower edge of the cutting wheel 30 does not advance along the path 21 taken by the vehicle 10 but moves up and down into and out of the cut along a generally vertical path relative to the highway surface 16. During operation, the crank assembly consisting of the two crankshafts 36 thus imparts an epicyclic, i.e., oscillatory circular motion as shown at 66 to its supporting framework 34 and cutter 30 relative to the rectilinear path of motion 21 of the vehicle 10 along the highway 16. The oscillation of the framework 34 thus has both a vertical component and a horizontal component that is aligned with the path of motion 21 of the vehicle 10. If desired, the periodic contact of the cutter 30 with the pavement can, in the alternative, be timed by an electric timer connected to an independent motor or actuator for revolving the framework 34.

When the cutting operation is to be terminated at the end of the day, the drive motor 64 is tamed off and the oscillating framework 34 can, if desired, be uncoupled by disconnecting the drive assembly **52*a*, for example with a clutch (not shown) or by raising the entire framework 18, e.g., by lowering the steering wheels 30 on the framework 18 enough so the cutting drum 30 will not touch the pavement at the lower end of its path of movement, i.e., the bottom of each epicycle. The depth of cut 14** can be controlled with shims (not shown) placed above the wheel axles.

Figure 5:
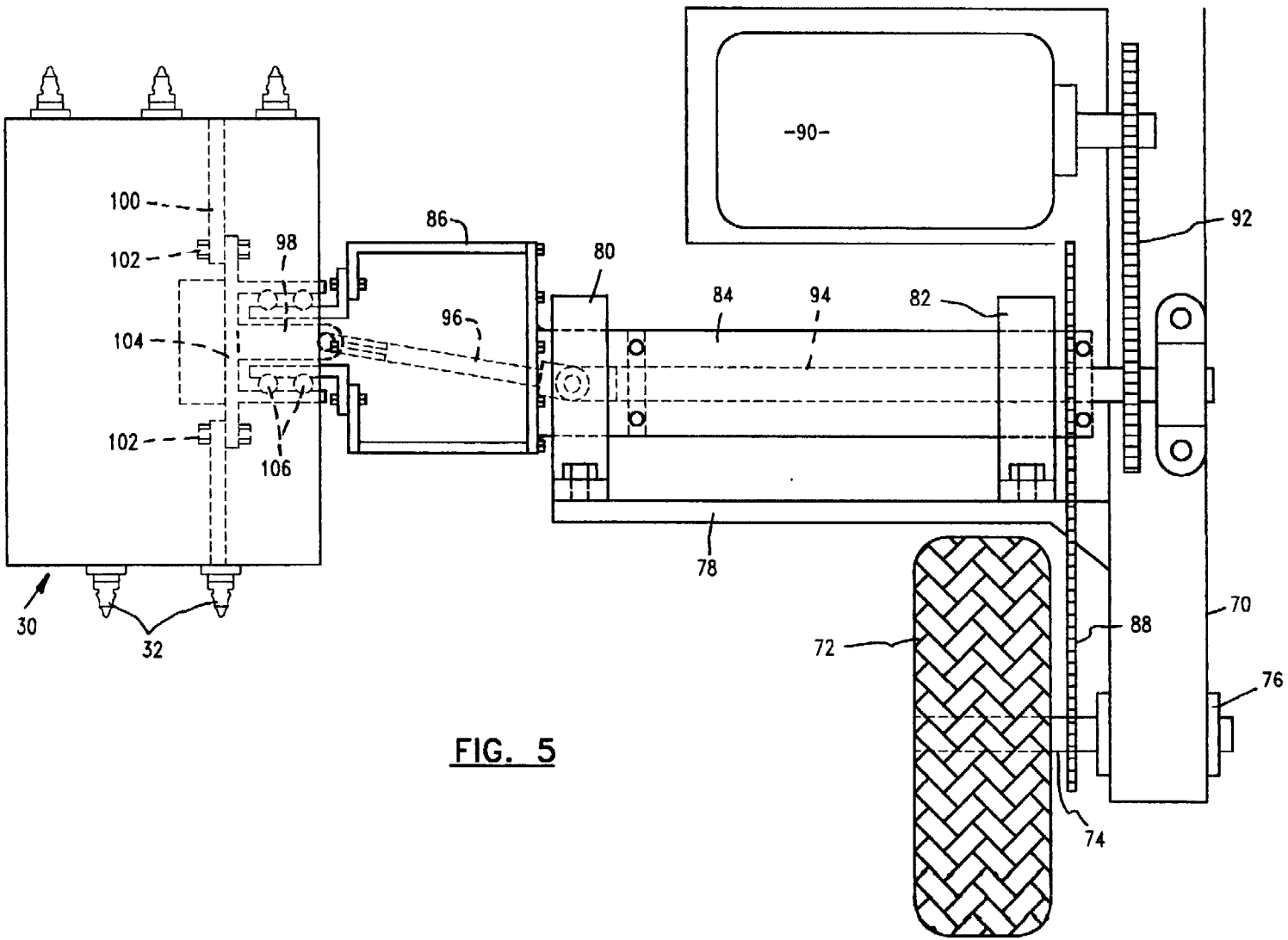
FIG. 5 is a plan view of another form of the invention.

Refer now to FIG. 5 which illustrates a modified form of the invention wherein the same numerals refer to corresponding parts already described.

Shown in FIG. 5 is a cutter for a rumble strip having a supporting framework 70 upon which are mounted four ground-engaging supporting wheels 72 connected to the framework 70 (only one of which is shown) and having an axle 74 which is journaled for rotation on the framework 70 within a bearing 76. Connected rigidly to the framework 70 is a supporting bracket or sub-frame 78 that carries a pair of laterally spaced apart bearings 80 and 82 for a revolving drive tube 84 having an offset shaft enclosure 86 connected rigidly to its left end. The enclosure 86 is offset, e.g., about two inches, with respect to the axis of the revolving tube 84 and is driven by means of a chain-and-sprocket assembly 88 from the ground wheel 72 so as to revolve one revolution each time the wheel 72 is advanced a selected distance, e.g., one foot, over the ground.

A drive motor 90, e.g., a diesel engine, is connected via chain-and-sprocket assembly 92 to a cutter drive shaft 94 which is coupled to a half-shaft 96 with universals at each end that is coupled to a cutter drive shaft 98. The cutter 30 has a circular center plate 100 suitably rigidly connected, e.g., by bolts 102 to a rotating hub 104 that is supported by ball bearings 106 on a collar rigidly affixed to the enclosure 86. In this way, the cutting wheel 30 is cantilevered from the hub 104 which is located near its center.

During operation, the motor 90 will rotate the cutting wheel 30 on its own central axis via the drive assembly 92, shaft 94, and shafts 94 and 98 while the wheel 72 causes the cutter 30 to simultaneously revolve bodily about a horizontal axis at the center of the revolving tube 84. In this way, the cutter 30 is intermittently raised and lowered relative to the surface of the road at a frequency controlled by the ground-engaging wheel 72 as it revolves bodily so as to periodically undergo retrograde motion opposing that of the vehicle framework 70 so as to enter and leave each cut 14 in the highway surface at the same point. As the speed of the vehicle framework 70 increases, the wheel 72 will turn faster, causing the cutting wheel 30 to revolve more rapidly, thereby entering and leaving each cut in the roadway more rapidly to provide a series of cuts that are always the same distance apart to form a complete rumble strip.

Refer now to FIGS. 6–12 which illustrate another embodiment of the invention wherein the same numerals refer to corresponding parts already described.

The vehicle indicated generally at 80 has a rectangular steel framework 18 supported on four wheels 20 as described above. In this case the front wheels 20 are connected to a steering assembly 22 similar to that described in FIG. 1 except that the steering is accomplished by a steering wheel 82 provided in a cab 84. The steering wheel 82 is coupled to the steering assembly 22 typically by means of a hydraulic coupling, only a part of which is shown at 86 in FIG. 6, or mechanically, if desired, by means of a steering shaft (not shown). The motive power unit in this case is a diesel engine 64 connected via hydrostatic pump 85 to a hydraulic motor 87 that is coupled through transmission 89 to the rear drive wheels 20. The engine 64 is also connected by means of a drive assembly 68 comprising multiple V-belts engaged over suitable pulleys to a shaft 108 and thence via chain-and-sprocket assembly 110 to a drive shaft 111. Shafts 108 and 111 are connected via chain-and-sprocket assemblies 112 and 114 to a pair of laterally spaced apart transversely extending cutter drive shafts 116 and 118, respectively. Connected to the drive shafts 116 and 118 are oscillating drive shafts 120, 122 which are provided with universal joints at each end and connected at their outer ends to the drive hub 104 of each of the cutting wheels 30, the latter being journaled for rotation on two mounting plates 124, 126. The plates 124, 126 are supported on aligned cranks C (FIG. 7) of four spaced apart crankshafts 5 which in this instance are arranged in two square patterns (one for each of plates 124 and 126) with each crankshaft 5 supported for rotation on a pair of longitudinally spaced apart platforms 128 and 130. The platforms 128, 130 are articulated, respectively, on the shafts 108 and 132 with a height adjustment, e.g., set screw 129 (only the one for the plate 128 being shown in FIG. 7) connected to the framework 18 for enabling the platforms 128, 130 to be raised or lowered as required to adjust the depth of the cut.

Figure 6:
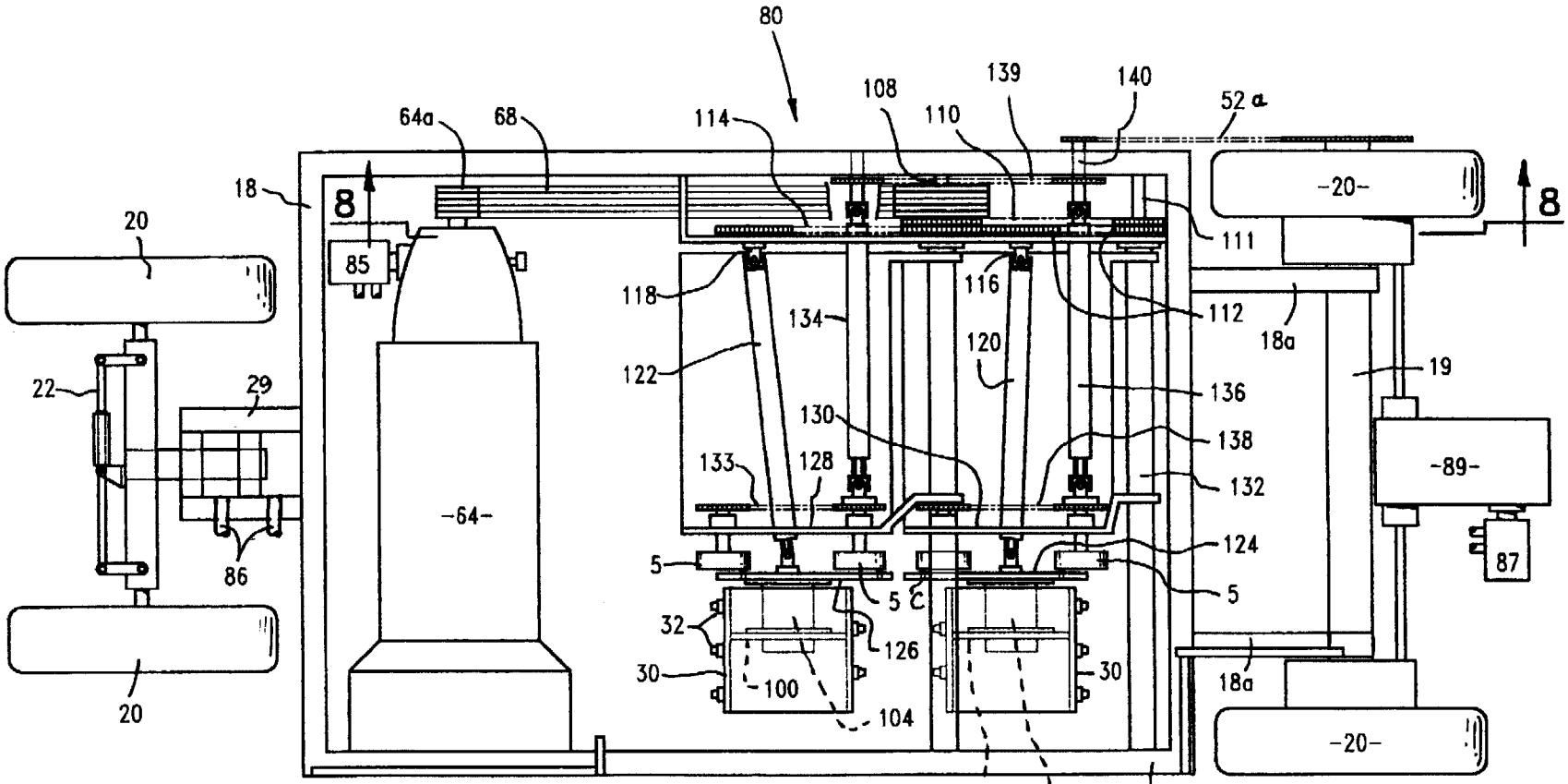
FIG. 6 is a plan view of still another form of the invention.

A drive shaft 134 having universal joints at each end drives the four crankshaft sprockets of the platform 128. Each of the crankshafts 5 on the platform 128 is driven at the same speed and direction by means of a single chain 133 (only a part of which is shown in FIG. 6) which is entrained over four chain sprockets arranged in a square pattern, one connected to each of the crankshafts 5.

Figure 7:
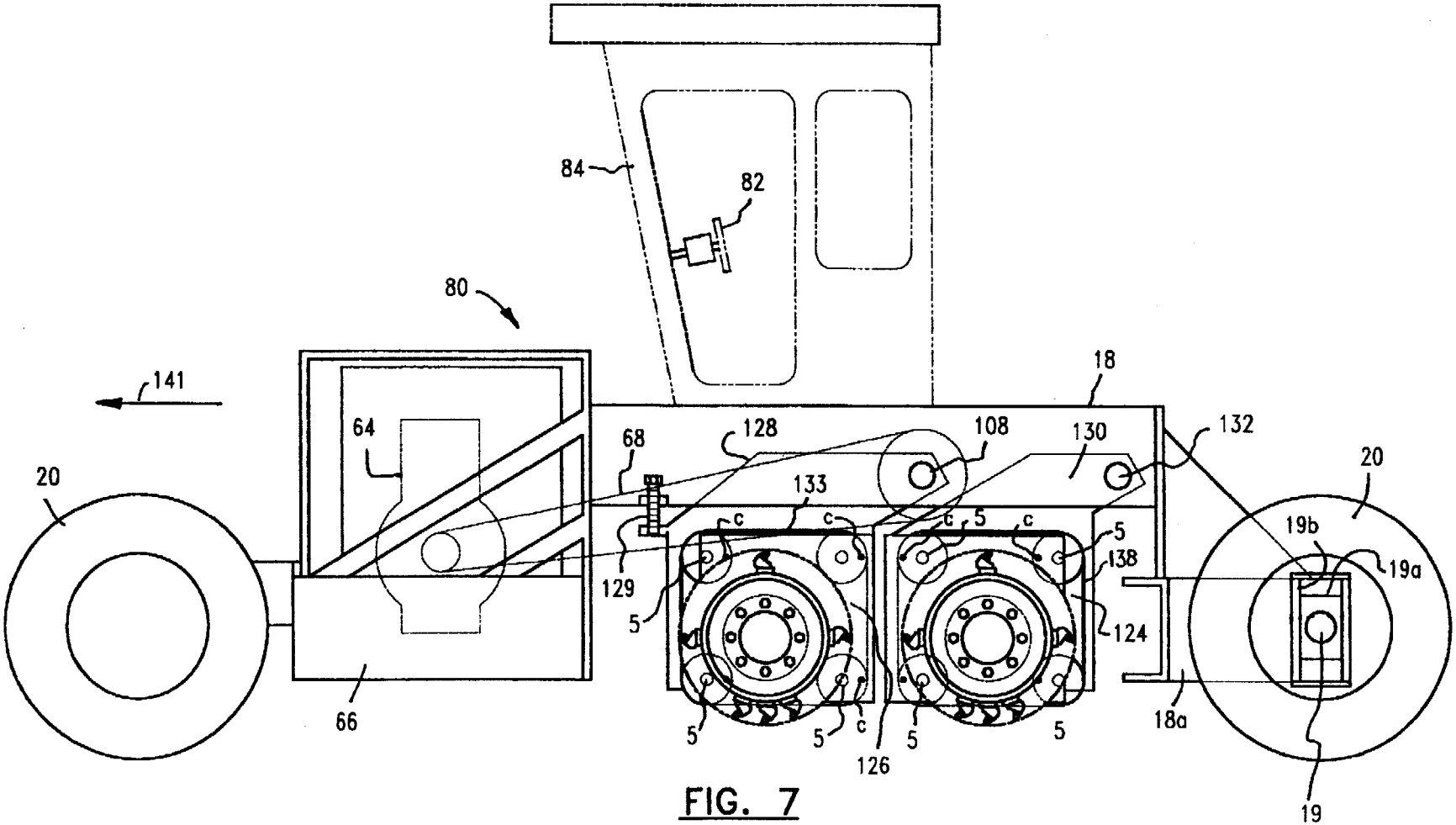
FIG. 7 is a side elevational view of the apparatus of FIG. 6.
Figure 8:
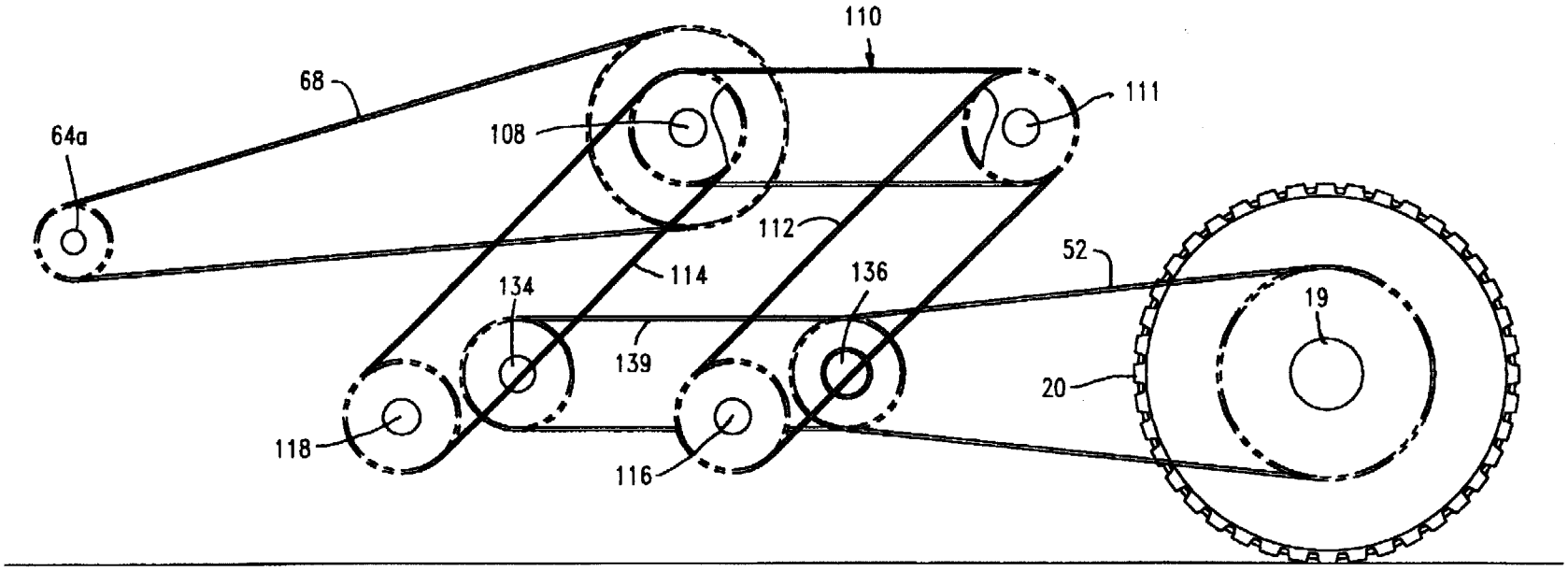
FIG. 8 is a diagram illustrating the drive train of the apparatus of FIGS. 6 and 7 on an enlarged scale.

The oscillating drive for the rear cutter 30 will now be described. A drive shaft 136 with universal joints at each end drives a chain-and-sprocket assembly 138 which consists of a single chain entrained over four sprockets arranged in a square pattern, each connected to one of four rear crankshafts 5 supported upon the rear platform 130. In this way the two sets of four crankshafts 5 cause each of the mounting plates 124, 126 to oscillate in a circle throughout operation. The oscillating motion drive shafts 134, 136 are in turn connected together by means of a chain-and-sprocket assembly 139 which is coupled via the outer end 140 of crankshaft 136 to a chain-and-sprocket assembly **52*a* that is driven by the ground-engaging wheel 20. It will be noticed that the crank C in each drive shaft 5 on platform 128 is aligned at the same angle of rotation as each of the others and extends rearwardly at the instant shown in FIG. 7, whereas those supported on platform 130 extend forwardly at the instant illustrated. All of the crankshafts 5 in both cases rotate in a counter-clockwise direction as seen in FIG. 7, causing the cutting wheel mounting plates 124, 126 to be 180 degrees out of phase with both oscillating, i.e., revolving, so as to rise and fall opposite one another and to advance each on the path of travel 141 of the vehicle as the other moves rearwardly with a retrograde motion at the same speed but in the opposite direction that the vehicle moves over the ground so as to cancel out the forward motion of the vehicle which enables each cutting wheel 30 to enter and leave the cut 14** along a generally vertical stationary path.

The rear wheels 20 in this case are supported on an axle that is mounted at 19 on a sub-frame **18*a*. Thus, each of the cutting wheel mounting plates 124 and 126 is driven with an oscillatory motion, so that when one is lowered to the cutting position the other is raised to its uppermost position. These cutters cut alternately in a two-foot cutting pattern with alternate cutting wheels 30 engaging the pavement every other time to provide a one-foot spacing between the centers of the cuts 14 that make up a complete rumble strip. When cutting is finished and the vehicle 80 is to be moved without cutting the roadway, the oscillatory motion to the cutting wheels 30 is discontinued, either by disconnecting a clutch (not shown) or, if desired, the cutting wheels 30 can be elevated away from the road by lowering the wheels 20 and axle support 19*a* in a slot 19*b* (FIG. 7**).

Figure 9:
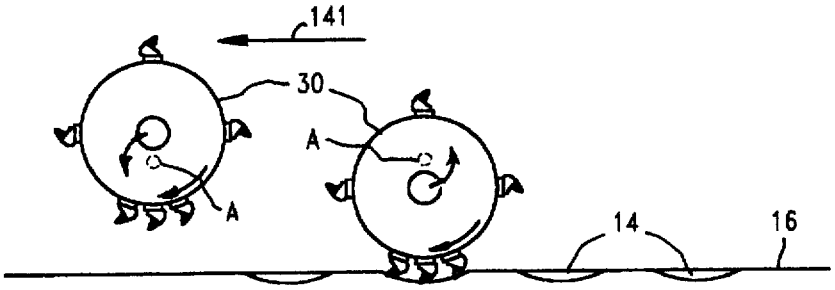
FIGS. 9–12 illustrate in sequence the stages in cutting grooves that form a rumble strip using the apparatus of FIGS. 6–8.

Oscillatory motion which is imparted to the cutting wheels 30 so that the cuts 14 are formed alternately is illustrated in FIGS. 9–12 which show in sequence the revolution of both cutting wheels 30 about their axes of revolution A at 90-degree intervals as the vehicle moves from right to left in the figures along a path of motion 141 (FIG. 9).

Figure 10:
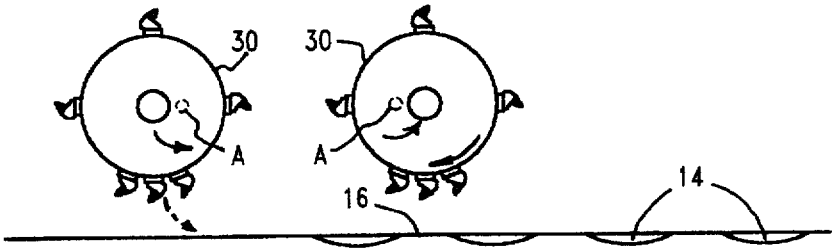
Figure 11:
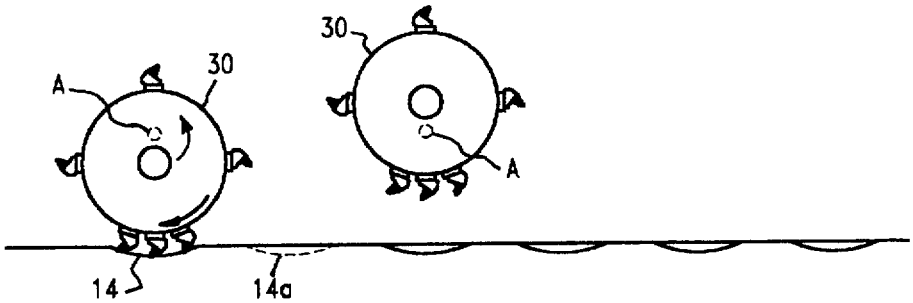
Figure 12:
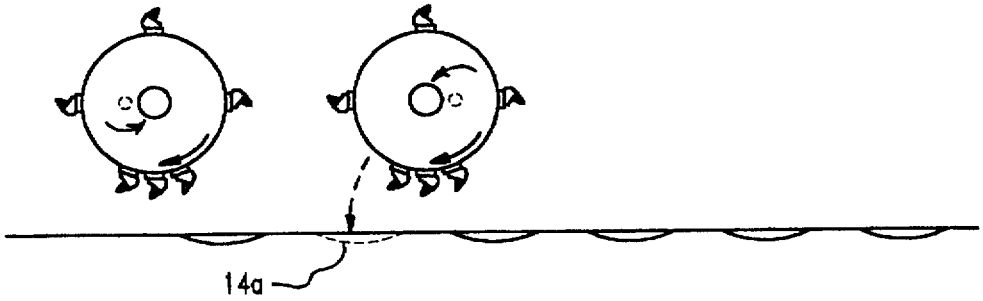

In FIG. 9 the rear cutting wheel 30 is making a cut at the right, while the front cutting wheel 30 is elevated all the way. In FIG. 10, which illustrates conditions 90 degrees after FIG. 9, the rear cutting wheel 30 is elevated halfway and the front cutting wheel 30 is lowered half-way to its cutting position. In FIG. 11, the front cutting wheel 30 is lowered all the way and is producing a cut at 14 with a space provided to the right of it for the next cut 14*a* that is to be made by the rear cutting wheel 30 a moment after the conditions shown in FIG. 12 so as to form a series of uniformly spaced apart cuts 14 to provide a complete rumble strip.

Refer now to FIGS. 13–16 which illustrate another embodiment of the invention wherein the same numerals refer to corresponding parts already described.

In this form of the invention a vehicle is provided similar to that as shown in FIGS. 1–4 with the following changes. The vehicle framework 18 has downwardly extending mounting brackets 160 to which is connected a box-shaped sub-frame 162 having a pair of laterally spaced apart, parallel, longitudinally extending walls 164, 166 each provided with a pair of cam slots 164*a*, 164*b*, 166*a*, and 166*b*. Inside the sub-frame 162 is a cutting wheel support framework 168 having four cam followers F mounted for rotation on the framework 168 and each extending into one of the cam slots 164*a*, 164*b*, 166*a* and 166*b*. The rear drive wheel 20 is connected through chain-and-sprocket assembly 170 via right-angle gear drive 172 to a drive shaft 174, thence through second right-angle drive 176 to a drive shaft 178 which is coupled via bevel gear sets 180, 182 to a reciprocating actuator means, in this case a pair of ball reversers 184, 186 in which the movable sleeves 188, 190 are coupled by means of connecting plates 192, 194 to the oscillating cutting wheel supporting framework 168. The cutting wheel 30 itself has a center shaft 60 which is rotated by a drive means, in this case a hydraulic drive motor 198 connected to a suitable power source such as the internal combustion engine 64 coupled to a hydraulic pump (not shown).

Figure 14:
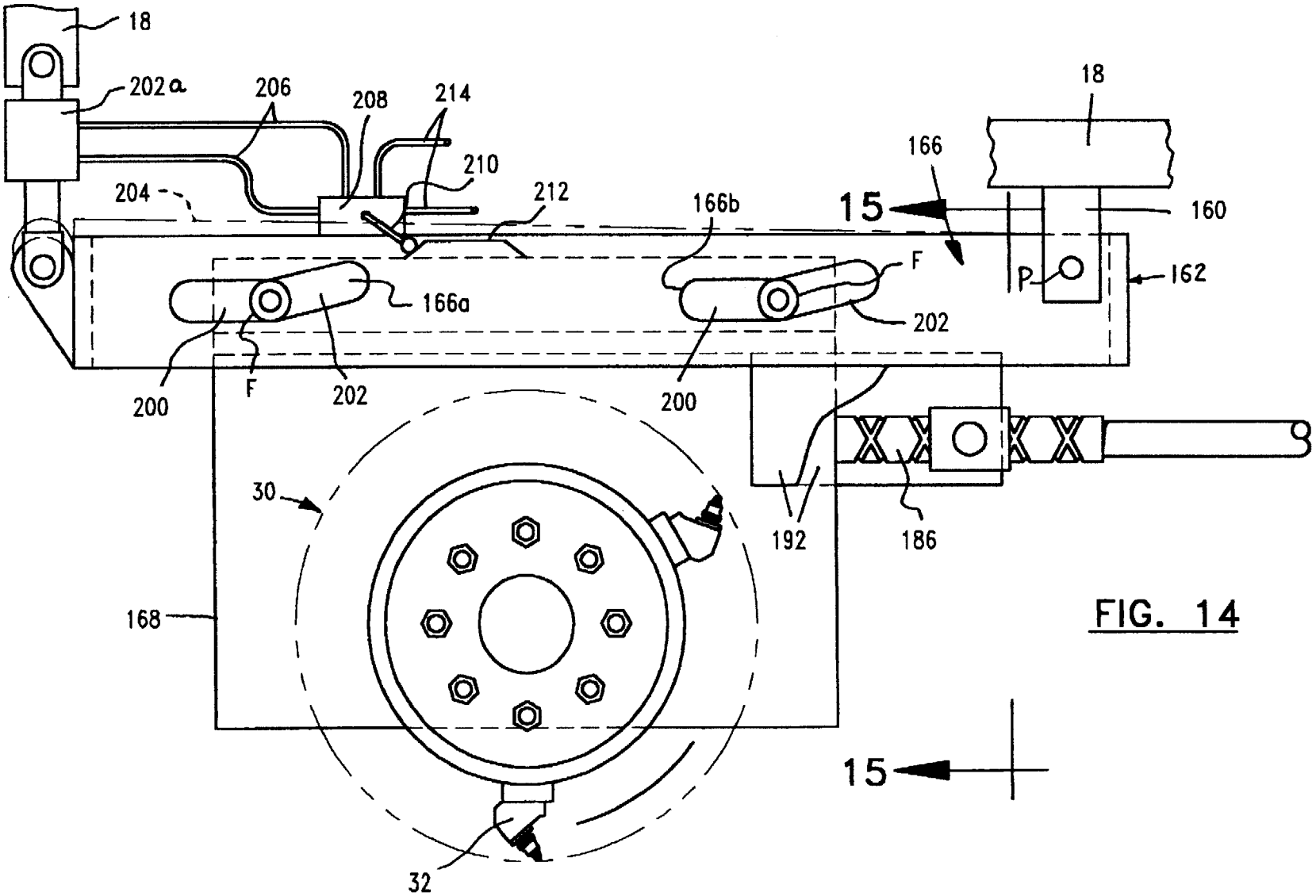
FIG. 14 is a vertical sectional view taken on line 14—14 of FIG. 13.

The cam slots 164*a*, 164*b*, 166*a* and 166*b* in the plates 164, 166 each have a flat section 200 and an inclined section 202 (FIG. 14) inclined at an angle of about 15 degrees so that when the ball reversers 184, 186 drive the roller framework 168 toward the left in the figure, framework 168 and cutting wheel 30 are lowered into contact with the pavement and thereafter travel at the same elevation as long as the cam followers F are in the horizontal position 200 to force the cutting wheel 30 into the cut. When the end of the cut is reached, an actuator 202*a* connected between the sub-frame 162 and a portion of the main framework 18 elevates the sub-frame 162 to the dotted line position 204 (FIG. 14). The actuator 202*a*, e.g., a hydraulic cylinder actuator, can be operated by means of hydraulic lines 206 coupled to a hydraulic valve 208 having a cam operating lever 210 that is raised and lowered by contact with a cam 212 at the top of the cutting wheel supporting framework 168. Hydraulic power is supplied from a suitable power source through supply lines 214.

Figure 16:
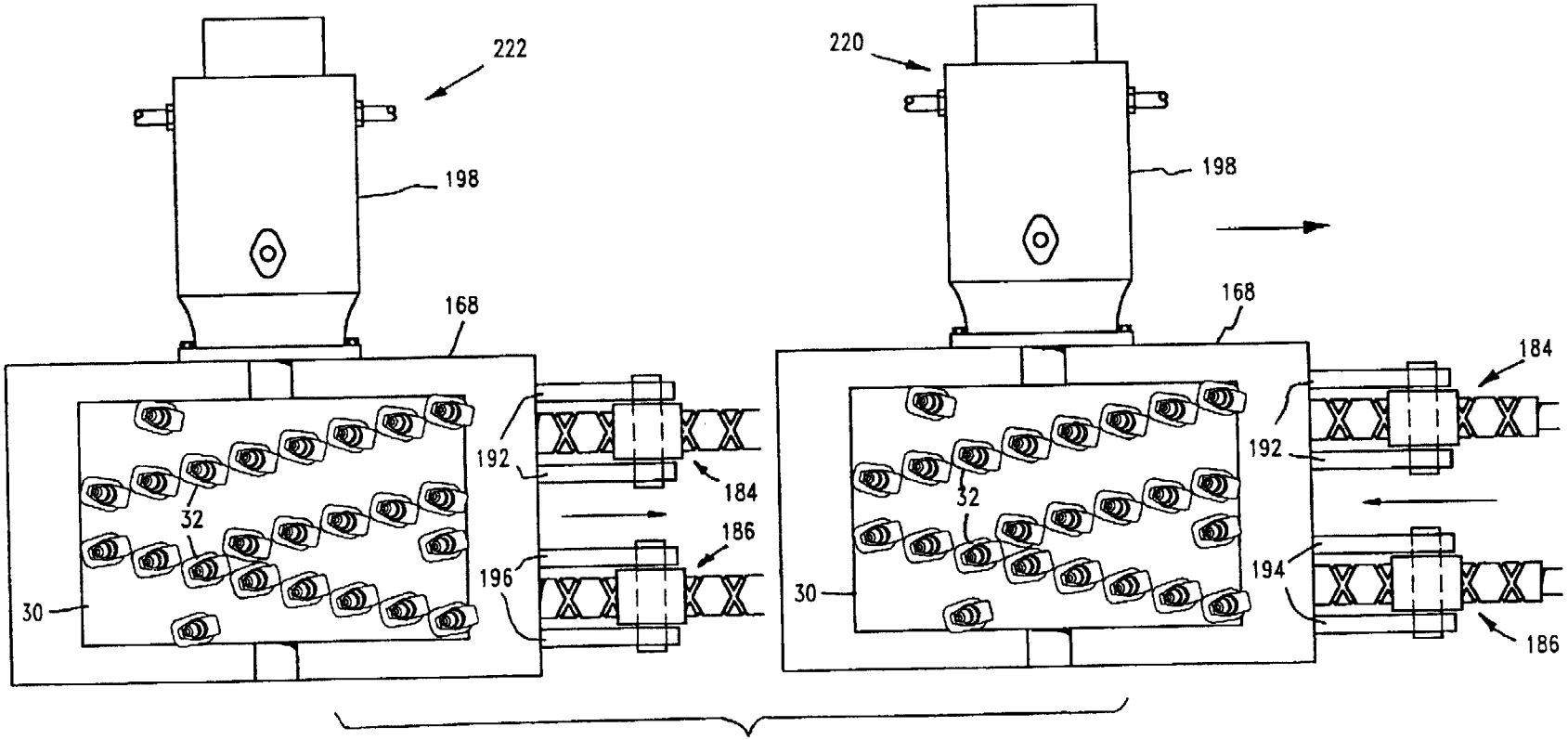
FIG. 16 is a diagrammatic plan view of another form of apparatus embodying the invention.

Refer now to FIG. 16 which shows another embodiment of the invention.

Figure 13:
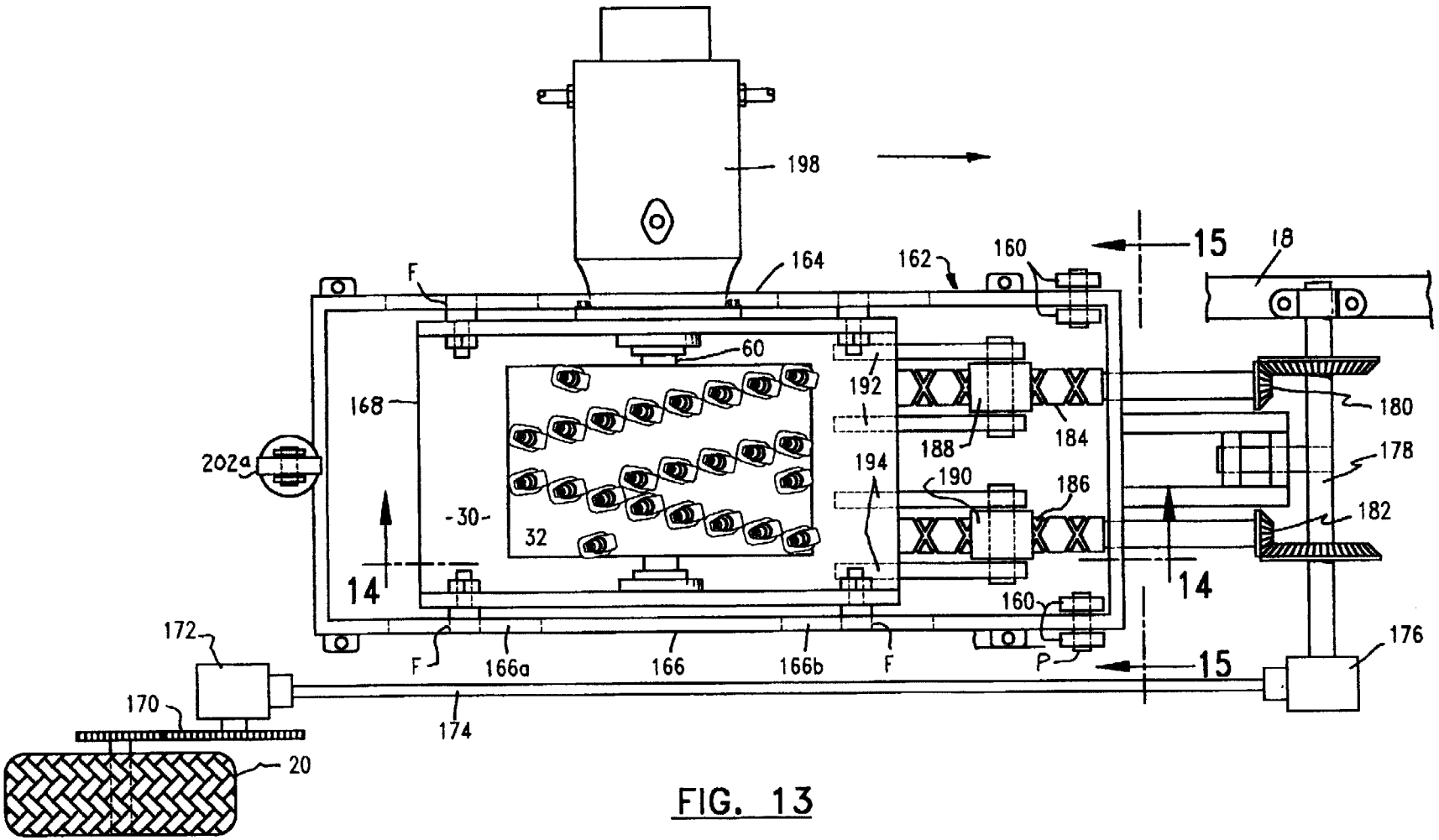
FIG. 13 is a diagrammatic plan view of an apparatus embodying another form of the invention.
Figure 15:
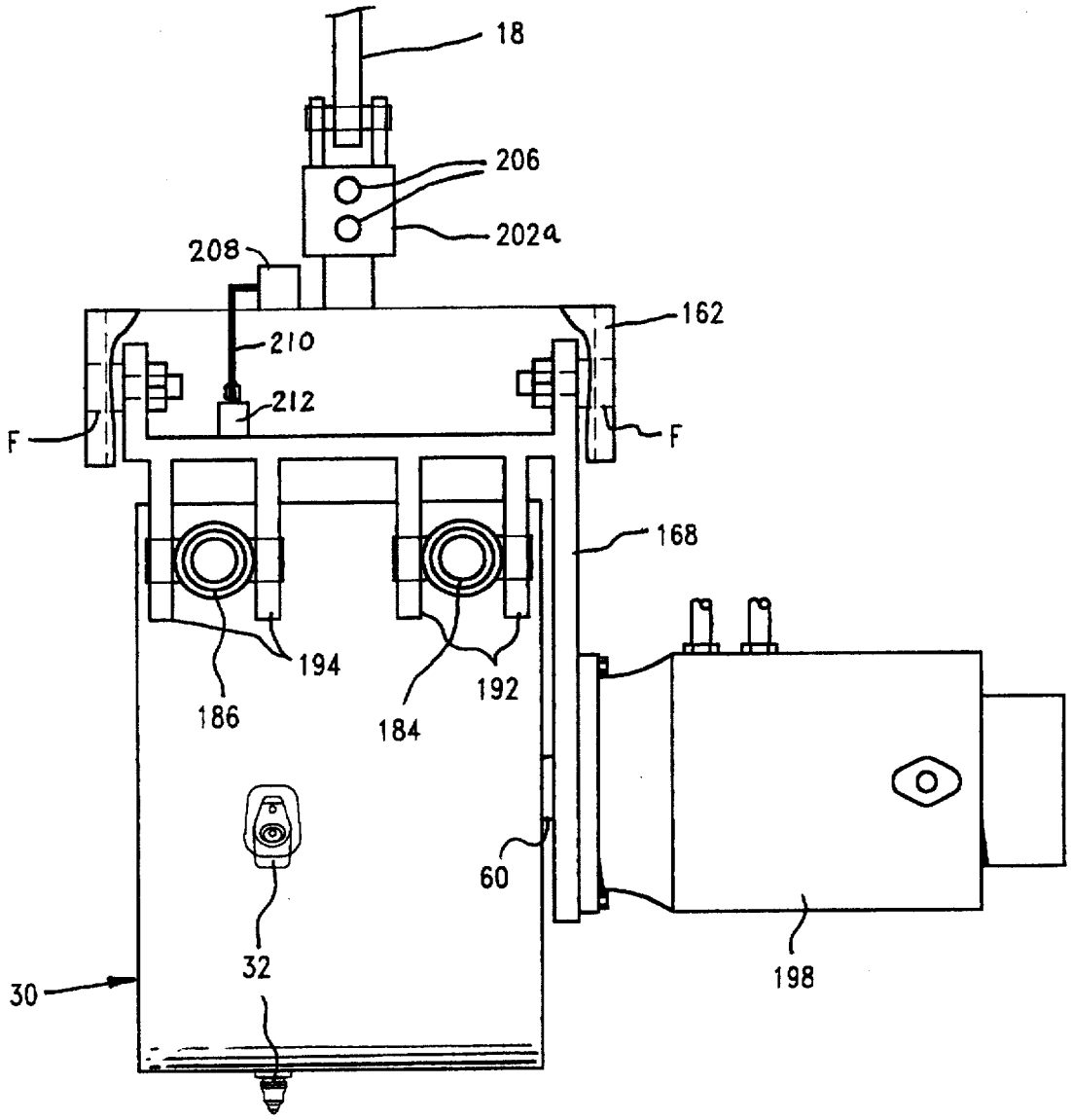
FIG. 15 is a vertical sectional view taken on line 15—15 of FIG. 14.

FIG. 16 is a plan view showing how two cutting units described in FIGS. 13–15 are mounted together in a single vehicle to alternately and sequentially cut a series of grooves in a roadway. The apparatus includes two cutting assemblies as shown in FIGS. 13–15 mounted in longitudinally spaced relationship in one vehicle. It should be understood that the actuators, in this case the ball reversers 184, 186, of the front and rear units shown at 220 and 222, respectively, are set to run at the same speed but in the opposite sense so that the front unit 220 moves rearwardly as shown in FIG. 16 while the rear unit 222 moves forwardly. The cutting wheels 30 will also be raised and lowered alternately to thereby cut the grooves 14 alternately and sequentially in the surface of the roadway 16 in generally the same manner as already described in connection with FIGS. 9–12.

The embodiment of FIGS. 13–16 has an important advantage in that it enables each cutting wheel 30 to be engaged in the cut for a longer period of time due to the presence of the flat section 200 of each of the four cam slots (FIG. 14), thereby further improving cutting and vehicle speed. Both of the embodiments shown in FIGS. 6–12 and 16 employ two cutting wheels 30 that operate alternately for cutting the grooves 14 in sequence. This has an important advantage in reducing the overall vibration of the apparatus, because when one cutting wheel 30 is moving in a forward direction the other is moving in the reverse direction, or when one is moving upwardly the other is moving downwardly, thereby assuring the smoothness of operation as well as doubling the capacity of the machine due to the use of two cutting wheels. The double cutting wheel can therefore be thought of as self-balancing.

The invention has proved highly successful in operation and has already been run at speeds above 150-feet-per-minute.

Many variations of the present invention within the scope of the appended claims will be apparent to those skilled in the art once the principles described herein are understood.

What is claimed is:

1. An apparatus for cutting highway rumble strips comprising, a vehicle including a supporting framework, a plurality of ground-engaging wheels rotatably mounted on the framework for supporting the vehicle and allowing the vehicle to move along a highway, a cutter supported on the framework for producing a series of spaced apart cuts in the pavement of the highway which together comprise a rumble strip, a means connected to the cutter to raise and lower the cutter into and out of each cut and to periodically impart retrograde motion to the cutter relative to the framework to cause the cutter to temporarily discontinue its forward motion relative to the highway as each cut is made such that the cutter moves relative to the vehicle at substantially the same speed the vehicle moves along the highway but in the opposite direction as each cut is produced to thereby cancel out the forward motion of the vehicle so that the cutter remains generally stationary relative to the path of the vehicle as each cut is produced, whereby the vehicle as a whole moves along the highway without substantially increasing the size of each of the cuts produced by the cutter relative to a cut produced when the vehicle is stationary.

2. The apparatus of claim 1 wherein the cutter is a toothed wheel and a drive means is connected to the toothed wheel for imparting rotation to the wheel on a central axis that extends transversely to the path taken by the vehicle.

3. The apparatus of claim 1 wherein the cutter is supported upon the framework for epicyclic motion by revolving the cutter around a transversely extending axis on a path that opposes the direction of the vehicle on the highway while the cutter forms each cut therein.

4. The apparatus of claim 1 wherein the vehicle includes an oscillating framework and a drive means is connected between the supporting framework and the oscillating framework for imparting epicyclic movement to the oscillating framework relative to the path of the vehicle, and the epicyclic motion has a vertical component and a horizontal component that is aligned with the path of motion of the vehicle.

5. The apparatus of claim 1 wherein the vehicle includes a cutter supporting framework that is connected to the vehicle for circular oscillatory movement such that any point thereon oscillates about a horizontal axis extending transversely of the vehicle and said oscillation is limed by a drive assembly connected to one of the ground-engaging wheels.

6. The apparatus of claim 1 wherein a cutter supporting framework that carries the cutter is supported upon the vehicle framework by at least a pair of horizontally disposed, longitudinally spaced apart crankshafts, each having a crank throw connected to the supporting framework, a drive means is connected between the crankshafts and a ground-engaging wheel for imparting circular oscillatory motion to the supporting framework and cutter.

7. The apparatus of claim 6 wherein the cutter is a cutting wheel having cutting teeth supported upon a circular surface thereof and a motive power source is connected thereto for imparting rotation to the cutting wheel.

8. An apparatus for cutting highway rumble strips comprising, a vehicle including a supporting framework, a plurality of ground-engaging wheels mounted for rotation on the framework for supporting the vehicle and allowing the vehicle to move along a highway, a cutting means supported on the framework for producing a series of spaced apart cuts in the pavement of the highway, an oscillation-imparting drive tube is mounted to revolve upon the framework, a drive assembly is connected between the drive tube and one of the ground-engaging wheels for revolving the drive tube, an offset shaft enclosure is connected to one end of the drive tube, a cutting wheel is mounted for rotation upon the offset shaft enclosure upon an axis that is offset from a center axis of the drive tube, a motive power means is supported upon the framework and a drive means is operatively connected between the motive power means through the drive tube and the offset shaft enclosure to rotate the cutter upon the offset shaft enclosure, whereby the revolution of the enclosure and cutting means imparted thereto by the drive tube periodically imparts retrograde motion to the cutting means relative to the framework for causing the cutting means to temporarily discontinue its forward motion relative to the highway as each cut is made such that the cutting means moves a direction opposite that of the vehicle as each cut is made to thereby cancel out the forward motion of the vehicle so that the cutting means remains substantially stationary relative to the path of the vehicle as each cut is produced.

9. The apparatus of claim 8 wherein the framework includes a sub-frame having a pair of spaced apart bearings and the drive tube is mounted to rotate upon the bearings with the offset shaft enclosure and cutting wheel supported by said spaced apart bearings.

10. An apparatus for cutting highway rumble strips comprising, a vehicle including a supporting framework, a plurality of rotatable ground-engaging wheels mounted on the framework for supporting the vehicle and allowing the vehicle to move along a highway, a pair of cutters mounted upon the vehicle, each cutter is supported on the framework for producing a series of spaced apart cuts in the pavement of the highway, a means connected to each cutter for periodically imparting retrograde motion to the cutter relative to the framework for causing the cutter to temporarily discontinue its forward motion relative to the highway as each cut is made such that the cutter moves relative to the vehicle in the opposite direction from the vehicle as each cut is being made to thereby cancel the forward motion of the vehicle, means for alternately raising the cutters and lowering the cutters into engagement with the pavement and for imparting the retrograde motion to each of the cutters while a cut is being formed, whereby during cutting each cutter moves rearwardly relative to the vehicle at substantially the same speed the vehicle moves along the highway.

11. The apparatus of claim 10 wherein each cutter is mounted upon a supporting member and oscillatory motion is imparted to each supporting member that is 180 degrees out of phase with the other supporting member to thereby lower each of the cutters alternately to a position for forming one of the cuts and to simultaneously move the same cutter in the opposite direction that the vehicle moves along the highway.

12. The apparatus of claim 11 wherein the supporting member is a supporting plate with a plurality of crankshafts connected thereto for imparting the oscillatory circular motion to the cutter so that the cutter revolves responsive to the rotation of the crankshafts, the crankshafts are connected to each other and are rotated at a speed that is synchronized with the movement of the vehicle relative to the highway.

13. The apparatus of claim 11 wherein the apparatus includes cam means operatively associated between the cutter supporting member and the vehicle, a first actuator means is coupled to the supporting member for shifting the cutter longitudinally of the vehicle and the cam includes an inclined ramp surface for raising and lowering the cutter during said longitudinal movement, a second actuator is connected between the vehicle and the supporting member for raising the supporting member and cutter at one end of a stroke thereof and for lowering the supporting member and cutter at a second end of a stroke thereof.

14. The apparatus of claim 13 wherein at least one of the actuators comprises a ball reverser.

15. The apparatus of claim 13 wherein at least one of the actuators comprises a cylinder actuator operatively connected between the vehicle and the cutter supporting member for raising and lowering the cutter supporting member.

16. The apparatus of claim 10 wherein the apparatus includes a pair of longitudinally spaced apart cutters having cutting teeth thereon and a ball reverser assembly is operatively associated with each of the cutters for imparting intermittent, alternately reversing oscillatory motion in opposite directions to each of the cutters whereby the cutters cut said grooves in the highway and are moved by the actuators in a direction opposite the direction of movement of the vehicle during each cut.

17. The apparatus of claim 16 wherein cam means is operatively associated between the vehicle supporting framework for raising and lowering the supporting framework and the cutter supported thereon when the ball reverser is actuated.

* * * * *